US006555728B2

(12) United States Patent
Gonzalez et al.

(10) Patent No.: US 6,555,728 B2
(45) Date of Patent: Apr. 29, 2003

(54) PROCESS FOR DECONTAMINATION OF BALLAST PITCH MATERIAL

(75) Inventors: Luciano A. Gonzalez, Ancaster (CA); Blair F. Sim, Brampton (CA); Henry E. Kowalyk, Burlington (CA); James D. Harcus, Toronto (CA)

(73) Assignee: Kinectrics Inc., Toronto (CA)

( * ) Notice: Subject to any disclaimer, the term of this patent is extended or adjusted under 35 U.S.C. 154(b) by 111 days.

(21) Appl. No.: 09/923,798

(22) Filed: Aug. 8, 2001

(65) Prior Publication Data

US 2003/0036672 A1 Feb. 20, 2003

(51) Int. Cl.[7] ..... A62D 3/00; C10C 3/02

(52) U.S. Cl. ..... 588/207; 588/206; 588/218; 208/44; 208/45

(58) Field of Search ..... 588/205, 206, 588/207, 218, 224; 208/39, 40, 41, 42, 43, 44, 45

(56) References Cited

FOREIGN PATENT DOCUMENTS

CA 2316409 2/2002

*Primary Examiner*—Steven Bos
*Assistant Examiner*—Anthony Kuhar
(74) *Attorney, Agent, or Firm*—Ridout & Maybee LLP

(57) ABSTRACT

A two step process for destruction of polyhalogenated aromatic compounds contained in pitch from ballasts of fluorescent lamps comprises: (a) contacting the pitch with a sufficient amount of an organic solvent such that the pitch and the solvent together form a liquid phase in which the polyhalogenated aromatic compounds are dissolved; and (b) chemically destroying the polyhalogenated aromatic compounds in the liquid phase. In preferred embodiments of the process, the solvent comprises mineral oil and the polyhalogenated aromatic compounds comprise polychlorinated biphenyls. Chemical destruction of the polyhalogenated aromatic compounds preferably comprises treatment with an alkali metal dispersion, preferably sodium metal in mineral oil.

17 Claims, No Drawings

PROCESS FOR DECONTAMINATION OF BALLAST PITCH MATERIAL

FIELD OF THE INVENTION

The present invention relates to pitch material of the type used in ballasts of fluorescent lamps, which is typically contaminated with polyhalogenated aromatic compounds such as polychlorinated biphenyls (PCBs), and more specifically to processes for destruction of polyhalogenated aromatic compounds present in such pitch material.

BACKGROUND OF THE INVENTION

A typical ballast for a fluorescent lamp consists of a heavy gauge steel box surrounding a reactor (comprising a core and a coil assembly), a capacitor and a thermal protector. The capacitor is filled with a dielectric material, most commonly consisting of one or more polyhalogenated aromatic compounds such as PCBs.

The spaces between the steel box and the inner components of the ballast are typically filled with an asphalt-based seal potting material, also known as "pitch", which is solid at ambient temperature and which melts at a temperature of from about 110° C. to about 150° C. The pitch contained in a fluorescent lamp ballast typically contains some amount of polyhalogenated aromatic compounds, which may originate from dielectric fluid leaked from a faulty capacitor or which may be incorporated into the pitch as a fire retardant or the like.

Environmental and toxicological problems caused by the use of polyhalogenated aromatic compounds resulted in a restriction on their production under the Toxic Substances Control Act (TSCA) of 1976 and a complete ban of their manufacture by the EPA in 1979. New regulatory requirements were also imposed on the disposal of polyhalogenated aromatic compound-containing waste materials.

Although a variety of technologies are available for disposal of polyhalogenated aromatic compound-containing wastes, government regulatory requirements restrict and control their use in each jurisdiction. In the United States, the proper method for disposing of polyhalogenated aromatic compound-containing ballasts depends on their condition and on specific state and federal regulations. According to TSCA regulations, non-leaking ballasts may be disposed of in a municipal solid waste landfill. Leaking ballasts, on the other hand, must be incinerated at an EPA-approved high-temperature incinerator.

Due to potential future liabilities relating to disposal of polyhalogenated aromatic compound-containing wastes in landfills, incineration has become the preferred method for disposal of polyhalogenated aromatic compound-containing ballasts. The high cost of incinerating whole ballasts has, however, led to the development of alternative treatments whereby the components of the ballast are separated, with the metal components being recovered and the polyhalogenated aromatic compound-containing capacitor and pitch being incinerated.

In general, the pitch from fluorescent lamp ballasts contains very little, if any, polyhalogenated aromatic compounds. However, the cost of analyzing the polyhalogenated aromatic compound content of the pitch is generally higher than the cost of incineration, and therefore the pitch is usually sent for incineration without analysis. The incineration of large amounts of pitch to destroy relatively small quantities of polyhalogenated aromatics is wasteful.

To reduce the cost and efficiency of disposal, an improved method is needed for treatment of pitch from fluorescent lamp ballasts to destroy polyhalogenated aromatic compounds.

SUMMARY OF THE INVENTION

The present invention overcomes the above-mentioned disadvantages of the prior art by providing a process for destruction of polyhalogenated aromatic compounds contained in pitch from fluorescent lamp ballasts in which the pitch is combined with one or more organic solvents to form a liquid phase in which the polyhalogenated aromatic compounds are dissolved, followed by chemically destroying the polyhalogenated aromatic compounds in the liquid phase.

According to the process of the present invention, the pitch may be partially or completely melted before it is combined with the organic solvent, or may be combined with the organic solvent at ambient temperature and subsequently heated to dissolve the pitch in the solvent.

In a preferred embodiment of the present invention, the organic solvent s comprised of mineral oil which is optionally combined with one or more co-solvents in order to lower the temperature at which the pitch becomes dissolved.

Following formation of a single liquid phase comprising the pitch and the organic solvent, the polyhalogenated aromatic compounds dissolved therein are preferably destroyed by contacting the liquid phase with an alkali dispersion, as described in co-pending Canadian patent application Ser. No. 2,316,409, filed Aug. 18, 2000, for an invention entitled "Method for Decontamination of Low Level Polyhalogenated Aromatic Contaminated Fluid and Simultaneous Destruction of High Level Polyhalogenated Aromatics", the teachings of which are incorporated herein in their entirety. The polyhalogenated aromatic compounds contained in the single liquid phase may instead be destroyed chemically by other known processes for decontamination of materials containing polyhalogenated aromatic compounds, including but not restricted to reaction with a blend of potassium or sodium hydroxide with polyethylene glycol or reaction with potassium tert-butoxide.

The present invention thus provides a simple and economical method for destroying the relatively low levels of polyhalogenated aromatic compounds present in pitch, which avoids the need for pitch incineration.

In one aspect, the present invention provides a process for destruction of polyhalogenated aromatic compounds contained in pitch from ballasts of fluorescent lamps, comprising: (a) contacting said pitch with a sufficient amount of an organic solvent such that the pitch and the solvent together form a liquid phase in which the polyhalogenated aromatic compounds are dissolved; and (b) chemically destroying the polyhalogenated aromatic compounds in the liquid phase.

DETAILED DESCRIPTION OF PREFERRED EMBODIMENTS

Preferred methods for destruction of polyhalogenated aromatic compounds in pitch from fluorescent lamp ballasts are now described below. Prior to performing the process of the invention, the lamp ballast is preferably separated into its individual components. The metal casing and other components free from polyhalogenated aromatic compounds are recovered and recycled, where possible. The capacitor oil and the pitch are the chief components containing polyhalogenated aromatic compounds and are processed separately.

Pitch is a tar-like substance comprised of long-chain hydrocarbons, being solid at ambient temperatures and melting over a range of temperatures from about 110° C. to about 150° C.

The pitch is processed in a two step process according to the present invention. In the first step, the pitch is contacted with a sufficient amount of an organic solvent such that the pitch and the solvent together form a liquid phase in which the polyhalogenated aromatic compounds are dissolved. References to formation of a liquid phase by the pitch and the solvent as used herein refer to dissolution or dispersion of the pitch in the organic solvent to a sufficient extent that substantially all the polyhalogenated aromatic compounds present in the pitch become dissolved in the organic solvent.

In one preferred process of the present invention, the pitch is first heated prior to being combined with the solvent. Preferably, the pitch is heated to a temperature at which it is at least partially malted, typically about 110° C. to about 150° C., after which it is contacted with an organic solvent which is preferably pre-heated to a temperature at which substantial solidification of the pitch will not occur during mixing. The result is a solution of pitch in the organic solvent, which is preferably maintained at a temperature of about 90° C. for further processing in the second step of the process.

In another preferred process of the invention, the solid pitch is combined with the organic solvent and is subsequently heated until a single liquid phase is formed. In a typical process, using mineral oil as the solvent and a pitch containing PCBs in a concentration of about 20 weight percent, the pitch is dissolved within 30 minutes at a temperature of from about 70° C. to about 120° C.

The amount of solvent used to dissolve a given weight of pitch is of course dependent on the nature of the solvent and the temperatures employed. In general, it is preferred to use the minimum amount of solvent which will dissolve the pitch and which will maintain the pitch in solution upon cooling to ambient temperatures, without excessive thickening of the solution. Typically, the concentration of pitch in the solvent ranges from about 10 percent by weight to about 30 percent by weight, and preferably from about 15 percent to about 25 percent by weight.

It is preferred in the process of the present invention to select a solvent which is comprised of mineral oil, including those solvents which comprise mineral oil in combination with a co-solvent or which comprise mineral oils contaminated with polyhalogenated aromatic compounds. The selection of a mineral oil-containing solvent is preferred since the second step of the process is designed to accept a low-level PCB contaminated mineral oil as a feed solution, such contaminated oils typically being obtained from power transformers.

A co-solvent is preferably selected which will lower the temperature and/or increase the rate at which the pitch and the organic solvent form a single liquid phase. Preferred co-solvents are selected from inert organic solvents. The inventors have identified iso-octane, iso-propanol and methanol as preferred co-solvents, however, it will be readily apparent to one skilled in the art that a number of other co-solvents could also be useful.

Where the solvent is contaminated with dissolved polyhalogenated aromatic compounds, it preferably contains such substances in relatively low levels of between about 1 mg/kg and 50,000 mg/kg of solution, and preferably between about 2 mg/kg and 5,000 mg/kg of solution, in particularly preferred embodiments of the present invention, such contaminated solvents comprise low level PCB contaminated mineral oil obtained from power transformers, which may also contain other contaminants such as chlorobenzene.

The liquid solution or dispersion of pitch in the solvent is subsequently used as a feed material in the second step of the process, which comprises chemically destroying the polyhalogenated aromatic compounds dissolved in the solvent. In a preferred process of the present invention, the second step of the process comprises contacting the liquid phase produced in the first step with an alkali dispersion, as described in above-mentioned Canadian patent application Ser. No. 2,316,409. The process described in this patent application relates to the decontamination of a contaminated inert fluid which is contaminated with a low level of a polyhalogenated aromatic compound while simultaneously decontaminating a material which is contaminated with a high level of a polyhalogenated aromatic compound, by an exothermic polyhalogenated aromatic destroying reaction. The method comprises: (i) placing in a vessel (a) an inert solvent; (b) an alkali dispersion; and (c) the high level contaminated material; a second step of (ii) substantially contemporaneous with the conclusion of step (i), adding to the contents of the vessel the contaminated inert fluid in a quantity sufficient to maintain temperature of the contents below flash point of the contents; and (iii) allowing a reaction between the alkali dispersion and the polyhalogenated aromatics to proceed until the contaminated inert fluid and the material are decontaminated to produce decontaminated inert fluid.

The alkali dispersion utilized in the second step of the is obtained from an alkali metal selected from the group comprising lithium, sodium and potassium, with a dispersion of sodium metal in mineral oil being preferred.

The term "polyhalogenated aromatic compounds" as used herein may include polychlorinated biphenyls, polybrominated biphenyls, halogenated benzenes, halogenated biphenyls, polychlorinated dibenzofurans, chlordane and halogenated polynuclear aromatics. In most instances, the compounds will be polychlorinated biphenyls, either alone or as mixtures with hydrocarbon or silicone-based oils such as transformer oils, ballast oils, heat transfer fluids, or lubricants.

Preferably, the liquid solution or dispersion formed in the first step of the process of the present invention is used as the low level contaminated inert fluid in the second step, with the high level contaminated material of the second step preferably comprising dielectric fluid from capacitors found in fluorescent lamp ballasts or power correction capacitors.

The invention will now be further illustrated by the following examples.

EXAMPLE 1

Melting and Subsequent Dissolution of Pitch

PCB-contaminated pitch from fluorescent lamp ballasts was placed in a beaker and heated. The behaviour of the pitch was observed at several temperatures, as shown below.

| Temperature/° C. | Effect |
|---|---|
| 30 | Solid |
| 75 | Solid |

-continued

| Temperature/° C. | Effect |
|---|---|
| 90 | Softening |
| 100 | Softer |
| 110 | Some melting |
| 130 | Very fluid |
| 150 | Free flowing |

After cooling, the pitch was observed to solidify.

Molten pitch was mixed with mineral oil pre-heated to 90° C. to form a single liquid phase.

EXAMPLE 2

Mixing Pitch with Solvent and Heating to Dissolve Pitch

PCB-contaminated pitch (10 g) from fluorescent lamp ballasts was blended with Voltesso 35™ mineral oil (43 g) and heated with stirring. The pitch was completely dissolved in the solvent within 30 minutes at 120° C. The solution was allowed to cool to ambient temperature, with the pitch remaining dissolved in the solvent.

Although the invention has been described in connection with certain preferred embodiments, it is not intended to be limited thereto. Rather, the invention includes all embodiments which may fall within the scope of the following claims.

What is claimed is:

1. A process for destruction of polyhalogenated aromatic compounds contained in pitch from ballasts of fluorescent lamps, comprising the steps of:

(a) contacting said pitch with a sufficient amount of an organic solvent such that the pitch and the solvent together form a liquid phase in which the polyhalogenated aromatic compounds are dissolved; and (b) chemically destroying the polyhalogenated aromatic compounds in the liquid phase.

2. The process according to claim 1, additionally comprising the step of at least partially melting the pitch prior to step (a).

3. The process according to claim 2, wherein said step of at least partially melting the pitch comprises heating the pitch to a temperature of from about 110° C. to about 150° C.

4. The process according to claim 3 wherein, prior to step (b), the liquid phase is cooled to about 90° C.

5. The process according to claim 1 wherein, during step (a), the pitch and the organic solvent are heated.

6. The process according to claim 5 wherein, during step (a), the pitch and the organic solvent are first contacted at ambient temperature and subsequently heated to a sufficient temperature to form said liquid phase.

7. The process according to claim 1, wherein the organic solvent comprises mineral oil.

8. The process according to claim 7, wherein the organic solvent comprises mineral oil and a co-solvent comprising an organic solvent selected from the group consisting or iso-octane, iso-propanol and methanol.

9. The process according to claim 1, wherein the organic solvent comprises mineral oil contaminated with polyhalogenated aromatic compounds.

10. The process according to claim 1, wherein the organic solvent comprises mineral oil and step (b) comprises contacting said liquid phase with a chemical blend to destroy said polyhalogenated organic compounds.

11. The process according to claim 10, wherein the chemical blend comprises a blend of potassium or sodium hydroxide with polyethylene glycol.

12. The process according to claim 10, wherein the chemical blend is obtained by blending potassium tert-butoxide and a solvent.

13. The process according to claim 12, wherein the solvent is mineral oil.

14. The process according to claim 1, wherein said step (b) comprises contacting said liquid phase with an alkali dispersion and wherein the alkali dispersion is obtained from an alkali metal selected from the group consisting of lithium, sodium and potassium.

15. The process according to claim 14, wherein the alkali metal is dispersed in mineral oil and the organic solvent in which the polyhalogenated aromatic compounds are dissolved is mineral oil.

16. The process according to claim 15, wherein the alkali metal is sodium.

17. The process according to claim 1, wherein the polyhalogenated aromatic compounds are polychlorinated biphenyls.

* * * * *